United States Patent [19]

Weuger

[11] 4,046,174

[45] Sept. 6, 1977

[54] PNEUMATIC LOOM

[76] Inventor: Karl W. Weuger, Ward St., North Brookfield, Mass. 01535

[21] Appl. No.: 661,159

[22] Filed: Feb. 25, 1976

[51] Int. Cl.[2] ..... D03D 47/24

[52] U.S. Cl. ..... 139/437; 139/188 R; 139/439

[58] Field of Search ..... 139/429, 437, 438, 439, 139/143, 188 R

[56] References Cited

U.S. PATENT DOCUMENTS

| | | | |
|---|---|---|---|
| 3,412,763 | 11/1968 | Weuger | 139/438 |
| 3,416,572 | 12/1968 | Giavini | 139/439 |
| 3,461,919 | 8/1969 | Weuger | 139/437 |
| 3,868,976 | 3/1975 | Weuger | 138/437 |

FOREIGN PATENT DOCUMENTS

| | | | |
|---|---|---|---|
| 1,098,802 | 1/1968 | United Kingdom | 139/439 |

*Primary Examiner*—Henry S. Jaudon

[57] ABSTRACT

A pneumatic weft insertion system in which means are provided for inserting up to an entire length of a weft pick from an outside weft storage, the weft being stored within an open projectile shell prior to insertion. The system involves unidirectionally pneumatically propelling the projectile and weft filling into and through a warp shed and guiding the projectile by an externally provided air cushion.

10 Claims, 21 Drawing Figures

126
126'
111
124
7
30
147'
148'
147
148
145
118
149
160
161
125
165
166
163
164
156
155
152
162
158
139
138
151
315
159
157
146
154
153
143
141
142
137
134
150
136
128
140
144
135
127
129
130
131
132
90
52
191
190
192
133

PNEUMATIC LOOM

BACKGROUND OF THE INVENTION

This invention relates to pneumatic filling insertion in a loom, wherein the filling is supplied from a storage device located outside of the loom.

More particularly, pneumatic looms in the past have consisted of a number of types: in one type the filling is blown by a single nozzle and carried by a blast of air or jet stream through the shed. One disadvantage of this type is that the width of cloth which can be woven is limited due to a loss of flow velocity outside the nozzle at the potential jet core because the increasing turbulence within the surrounding boundry region of the jet stream which propels the filling. The turbulent air flow also causes the filling to untwist, so that only certain types of filling can be used. Still another disadvantage of this type of pneumatic loom is the large power consumption related to providing the necessary compressed air.

Another type of loom pneumatically stores yarn for several picks in a hollow projectile and propels the projectile mechanically through a shed. The size of the projectile still disallows high speed and it is a problem to draw yarn from the projectile uniformly. A more recent type of pneumatic loom has utilized a small shuttle more accurately referred to as a projectile to carry the free end of the filling through the warp shed. The filling end is either held mechanically within the projectile as shown for example in my U.S. Pat. No. 3,412,763 or held by friction as shown in my U.S. Pat. No. 3,395,737 where the filling is blown through a bore in the forward contour of the projectile during most of its flight. U.S. Pat. Nos. 3,831,640 and 3,868,976 show the projectile with blunt ends, where the filling is placed in one of the two annular chambers of the projectile in the form of a coil, so that the filling coils have a propensity to cling, and remain inside the said chamber during the larger portion of the flight. One disadvantage of this type of filling insertion is that the blunt shaped projectile cuts any warp yarns which protrude into the flight path of the projectile, which necessitates shutting down the loom and splicing the warp yarn. Also, the small annular chambers in the projectile limit the range of the weft yarn size.

BRIEF SUMMARY OF THE INVENTION

The present invention represents a pneumatic filling insertion system, wherein a number of novel weft leading projectiles, each carrying up to an entire pick length of weft yarn, are propelled one after the other from novel launching unit through a warp shed to a novel receiving device. More specifically, the invention relates to such a process which utilizes the fluid dynamic condition within the projectile during its flight, as well as the kinematics involving the weft yarn, to assist weft insertion. This invention is characterized by a number of novel projectiles of which one after the other is pneumatically loaded with at least a portion, and up to an entire pick, of weft, which is pneumatically propelled and guided by the means of a combined static and dynamic air cushion. The present invention provides a launching device within which simultaneously two projectiles are prepared for picking, along with means for altering the projectile location. A receiving device is located opposite the launching unit, and contains two deceleration chambers. The receiving device receives the projectile and transfers it to a transfer position, from which it is transferred back to the launching device. This invention also provides an annular chamber in which a vortex free airflow supports and assists the projectile during its motion. Means are also provided for monitoring the projectile position and filling location on each pick.

DETAILED DESCRIPTION OF THE INVENTION

Figure 1:
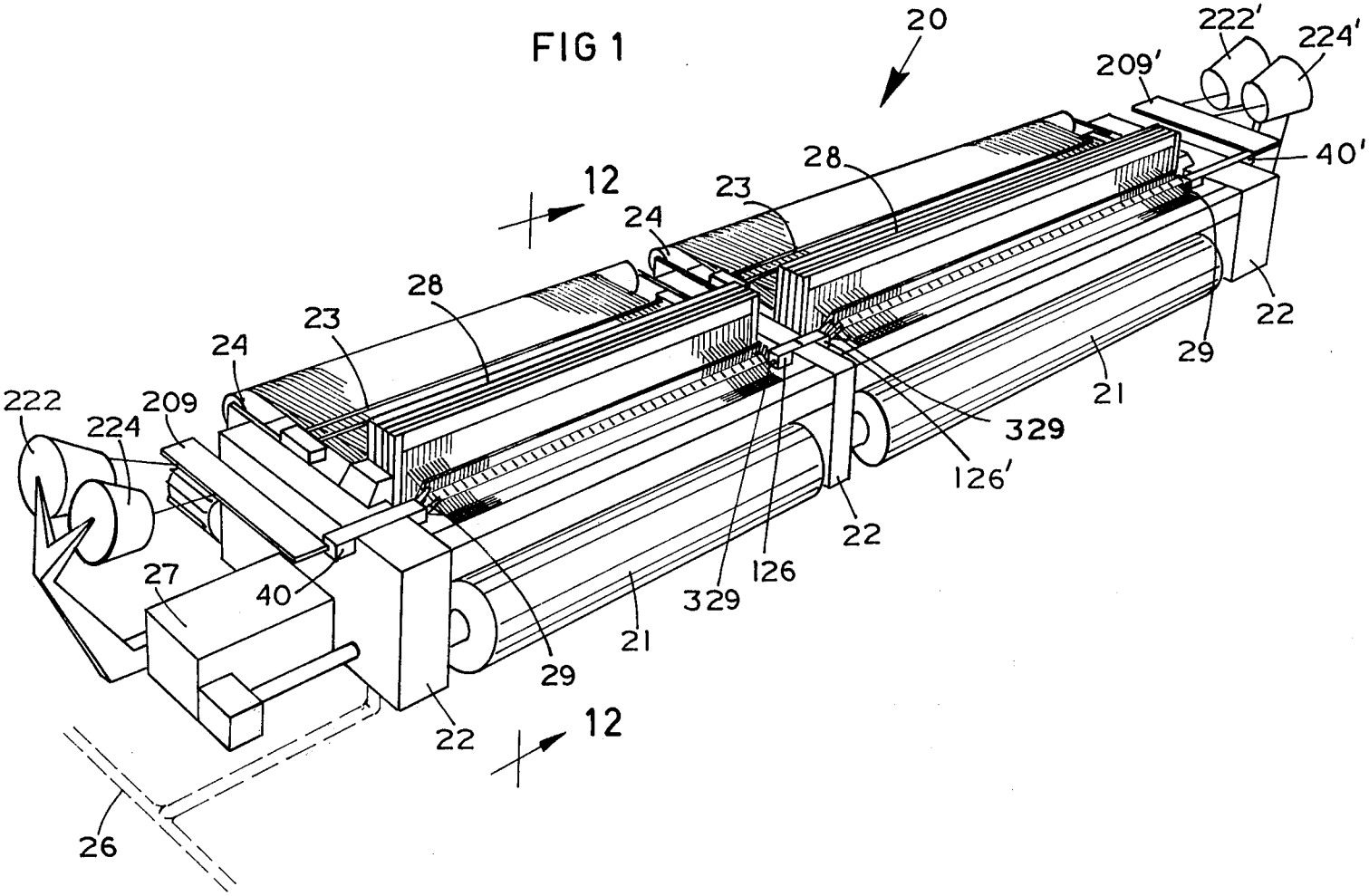
FIG. 1 is a perspective view of a loom incorporating the present invention.

Referring particularly to FIG. 1, there is shown a loom generally indicated by reference numeral 20 to which the filling insertion mechanism of invention is applied. Loom 20 includes the usual frame members 22, letoff beam 24, take-off means 21, warp stop 23 and heddle frames 28 which are operated by a shedding mechanism 27. A weft yarn cutting and gripping device 29 is incorporated between the launching unit and the warp shed, and a similar cutting and gripping unit 329 is situated between the warp shed and the receiving head mechanism which is situated on frame structure 22.

PROJECTILE

Figure 8:
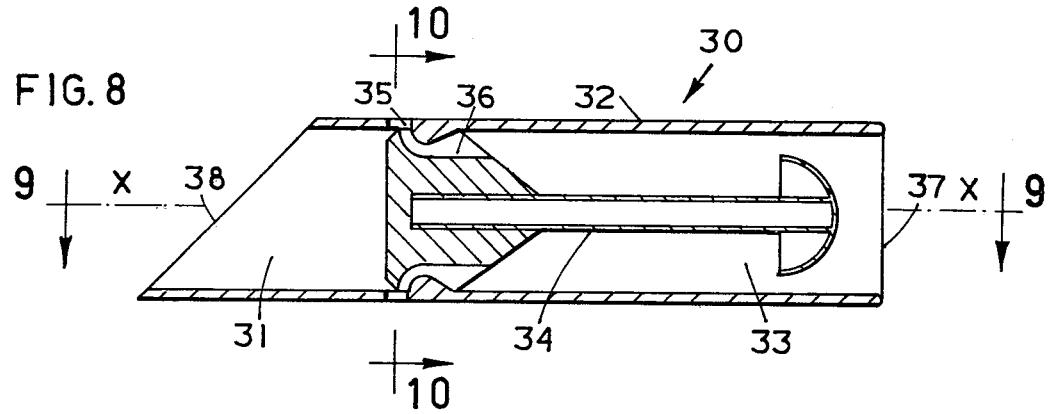
FIG. 8 is a longitudinal section of the filling insertion projectile.
Figure 9:
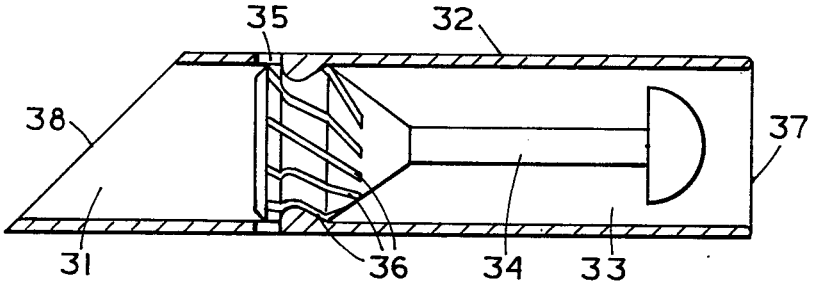
FIG. 9 is a horizontal section taken along line 9—9 of FIG. 8 showing the shell cut in half and a plan view of the flow deflector.
Figure 10:
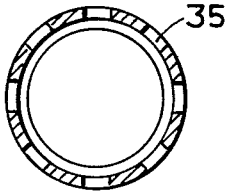
FIG. 10 is a vertical section taken along line 10—10 of FIG. 8 and looking in the direction of the arrows.

The projectile used to introduce a pick of yarn into the warp shed is generally shown in FIGS. 8, 9, 10 and 20. Up to the entire length of a weft pick is stored in a projectile which generally is indicated by the reference numeral. As shown in FIGS. 8–10, projectile 30 is generally a cylindrical tubular shell 32 bearing a generally ellipsoidal ring surface 38 which is at an angle to the longitudinal axis *x—x* of said shell at its leading end. Since the leading portion of the projectile is at an angle, encounters with out-of-place yarns in the warp shed will neither result in cutting the yarn nor in stopping the projectile, both of which can occur in other systems, but rather the out-of-place yarn will simply be pushed aside by the leading portion, allowing the projectile to pass. Since, as pointed out below, the projectile is supported by an air cushion during its flight, the projectile can easily turn in flight to push aside a yarn in any portion of the shed, thus resulting in minimal exertion or energy loss. The shell 32 also is penetrated by a plurality of holes 35 for the purpose of providing an air passage out the side of the projectile, both from scoop space 31 in the front part of the projectile and the slots 36 in the rearward yarn storage section of projectile 30. The internal portion of the shell 32 is substantially open within the ring contour or end 37 and the angular surface 38. This space within the tubular shell is divided by an air flow deflector 34 which is provided with a partition 39 that has a plurality of slots 36 extending from space 33 into a scoop 31 disposed at an angle to axis *x—x.* The function of the slots 36 is to allow an air pass from space 33 to scoop 31 and to maintain the vortex air flow which is introduced through the contour 37 together with the free end of filling when the filling is being placed in the form of a cylindrical coil around and along the deflector 34 by means described in the next section.

Figure 20:
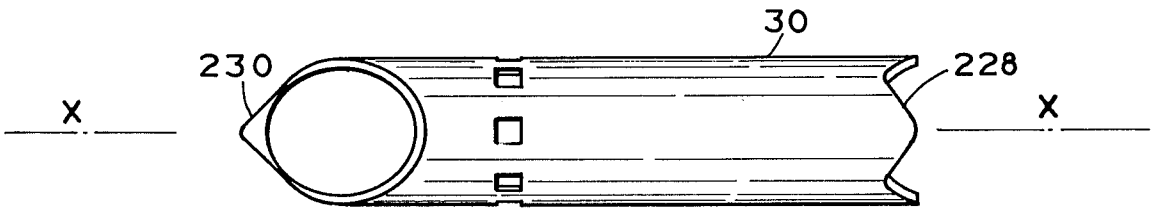
FIG. 20 is a top view of a preferred projectile of the present invention.

In the preferred configuration shown in FIG. 20, the trailing end of the projectile is scalloped, having wave shaped rim 228. The front edge 230 of the projectile is shaped to fit within the indentations of the wave shaped edge 228 of another projectile, so that as the projectiles are returned to the launching unit in conveyor tube 52, the front edge of each projectile will nest in the indention of the projectile in front of it. In this preferred embodiment, the stress exerted as the projectiles jostle one another in the conveyor tube is distributed over the entire nested area of edge 230, rather than being concentrated at the very tip, which will result in substantially increased projectile life.

PROJECTILE LAUNCHING UNIT

Referring to FIG. 1 there is situated at each end of the loom right and left hand projectile launching unit 40 and 40' each one bearing two filling insertion systems. Comparable portions of devices 40' will bear the same reference numerals as for device 40 with the addition of a prime.

Figures 2, 3, 4, 5:
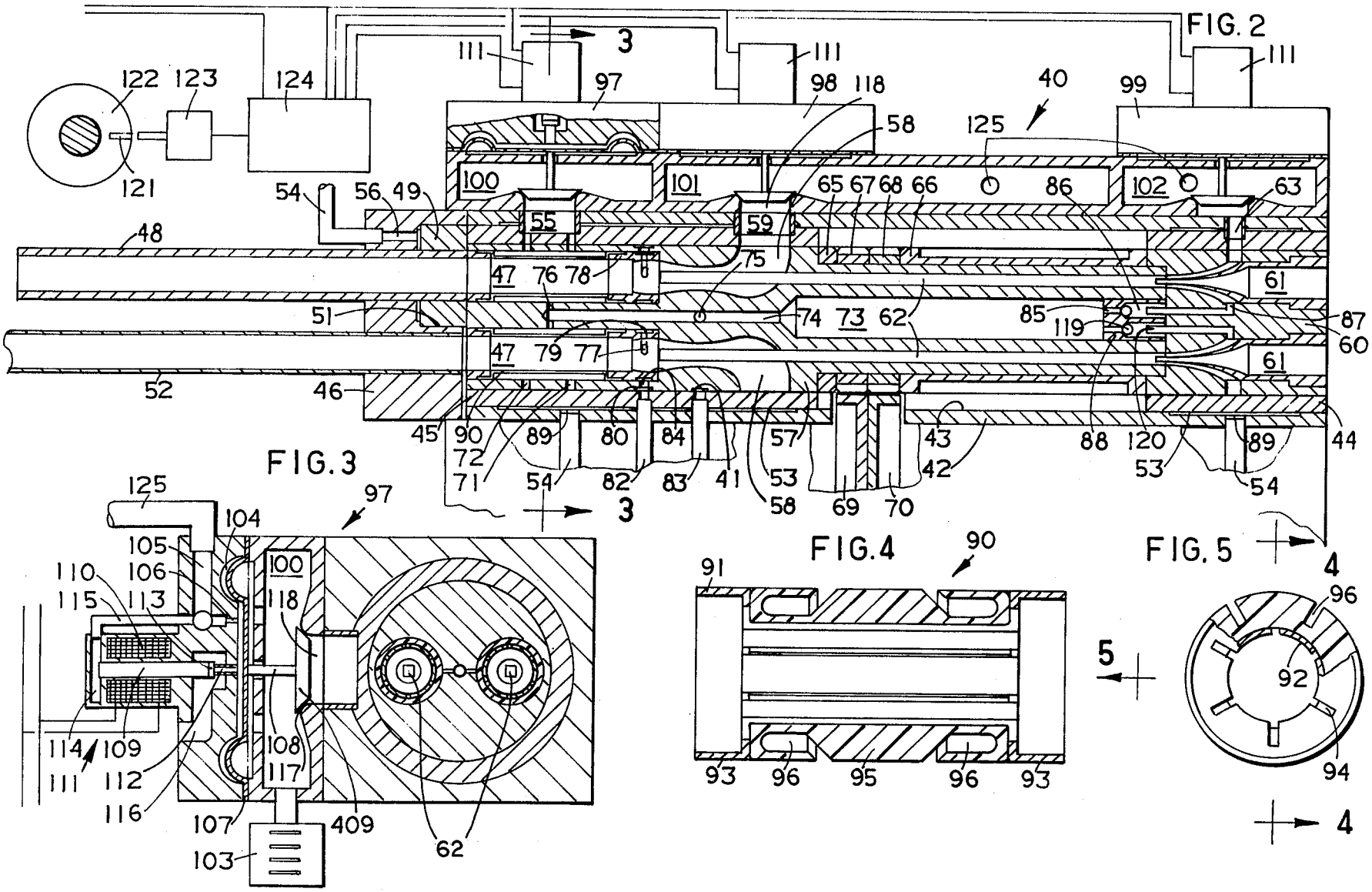
FIG. 2 is an enlarged longitudinal cross section of a projectile launching device shown at 40 in FIG. 1.
FIG. 3 is an enlarged horizontal section taken along line 3—3 of FIG. 2 looking in direction of the arrows.
FIG. 4 is an enlarged vertical section taken along line 4—4 of FIG. 5 illustrating a projectile holding unit.
FIG. 5 is an enlarged end view looking in direction of arrow 5 of FIG. 4 of one of the projectile holding units with a portion broken away.

Referring to FIG. 2 device 40 comprises a housing 42 which has a bore 43 within which are located air bearings 45 and 44. A housing extension 46 is attached to housing 42 which forms part of launching bore 47 by means of cylindrical tubular barrel 48. Air seal 49 is positioned in groove 51 surrounding the barrel 48, and a projectile conveyor 52 connects launching unit 40 with receiving device 126 also extending through housing extention 46. The central axes of launching barrel 48 and conveyor tube 52 lie at an angle to the vertical as indicated by line *z—z* in FIGS. 12 and 13. Pressurized air from high pressure system 26 (FIG. 1) is supplied to the air bearings 45 and 44 by annular grooves 53 around each bearing which are connected to conduits 54 by ports 89, conduit 54 also is connected to port 56 through which air seal 49 is pressurized. Air bearings 45 and 44 and air seal 49 are made of a porous material that allows air to penetrate from the grooves 53 toward bearing surfaces. Confined by bearing 45 and 44 are seal 49, the cylindrical filling insertion block consisting of a projectile propelling section 57 which has two expansion chambers 58 of which one is alternately pneumatically connected to aperture 59 adjacent valve port 118, of valve 98. Shown on the right hand side of FIG. 2 is nozzle section 60 with two nozzle inserts 61 which extend into chambers 62 located at longitudinal axis throughout the entire expansion chamber 58. A passageway 63 pneumatically connects alternately one of the chambers 62 to valve 99 by a port 118 and a pair of gears 67 and 68 are located on the cylindrical extension of block portion 57 and confined in longitudinal axis by spacer bushing 65 and 66 engaging gear segments 69 and 70 which apply rotational movement to insertion block 57. Gear segments 69 and 70 may obtain their rotational movement from any convenient source, e.g. by being connected as by cams or other means to the main loom drive (not shown). There is an annular pneumatic projectile holding unit 90 along each bore 47. These units 90 form part of the wall of bore 47, as shown in greater details in FIGS. 4 and 5. Since identical holding units 90 are placed in launching unit 40 and receiving device 126 only one of them will be described in detail. Each unit 90 consists of a sleeve 91 having an annular middle portion 92 and each end of the unit bears an enlarged sleeve shoulder section 93. A plurality of longitudinal slots 94 allow a deflection of the segmented portion of sleeve 92 and annular resilient liner 95, which surrounds and supports sleeve middle portion 92, and is confined in place by shoulder section 93. When pressurized air is applied through port 76 to liner grooves 96 it causes the liner 95 to deflect inwardly, which in turn also deflects the segmented sleeve portion 92 towards center axis of holding units 90. The sleeve 91 is made of a material suitable for frictionally holding the projectile effective upon pressurization of liner area 95 to engage the projectile when it is in bore 47. Projectile holding units 90 are located in launching unit 40 and 40', and receiving device 126 and 126' serve the purpose of positioning the projectile 30 for propulsion through the warp shed or for transfer from the receiving device 126 back to the launching unit 40 through a conveyor tube 52.

Pressurized air is supplied to the unit 90 from a high pressure source 26 indicated in FIG. 1, and pressurized air from source 26 is also supplied through conduits 125 to the solenoid valves 97, 98 and 99. When valve 97, which operates unit 90, is in closed position, the pressurized air supplied through segmental groove 41 and conduit 83 to port 75 pneumatically connects bore 73 and port 76 by bore 74 extending bore 73. Ports 76 restrict air flow and determine the air flow rate to unit 90. Referring particularly to FIGS. 2 and 3, the valve 97 is shown in a closed position so that unit 90 remains in pressurized, projectile-holding condition. Solenoid valve 97 has a discharge chamber 100 with an intake port 118 in line to aperture 55, which is pneumatically connected to unit 90 by bores 71 and 72 through a wall of bearing 45 and launching block 57. The discharge chamber 100 of valve 97 is freely connected to the atmosphere by means of muffler 103. Pressurized air from the pneumatic pressure system is supplied to a stabilizing annular chamber 104 through conduit 125 to passage way 105, which is connected to chamber 104 by a flow restricting bore 106. Chamber 104 is separated from the discharge chamber 100 by a diaphragm 107 which has a connecting rod 108 and a disc 119 attached to it. Valve 97 comprises a pilot valve 111 consisting of an electromagnet 110 and an iron core 109 slidable within magnet 110. A cylindrical bushing 112 extends into passageway 116 pneumatically connecting chamber 104 to passageway 116, which leads to the atmosphere. At one end of the iron core 109, facing bushing 112, is situated a resilient member 113 which is effective as a seal to chamber 104 when it is in closed position (shown in FIG. 3). The opposite end of iron core 109 extends in space 114 on top of electromagnet 110. Space 114 is supplied with pressurized air through conduit 115 from passageway 105. When the iron core 109 is lifted away from bushing 112 by magnetic force, pressurized air from the stabilizing chamber 104 suddenly escapes into the atmosphere through passageway 116. This reduces the pressure in chamber 104 so that the pressure within exhaust port 118 forces the disc 119 away from the sealing portion 117 of port 118, and pressurized air from unit 90 escapes through bores 72 and 71 to aperture 55 and port 118 into discharge chamber 100. Since pressurized air from the discharge chamber 100 can escape through the muffler 103 into atmosphere, all the grooves 96 within unit 90 are depressurized and the unit 90 is relaxed to a non-projectile-holding state. This allows a projectile 30 within launching bore 47 to be accelerated without frictional delay. The unit 90 within that bore 47 which is not in line with projectile conveying means 52 (i.e. the unit which is awaiting firing in proper firing position), remains pressurized after unit 90 has changed position to the launching location, where the pressure is released at a given point by valve 97 as described.

Referring again to FIG. 2, there are two more solenoid valves indicated generally at 98 and 99, which are structurally substantially identical. One difference is that chamber 101 of valve 98 and chamber 102 of valve 99 are not connected to the atmosphere, so that those chambers function as pressure accumulators. Pressurized air is supplied to accumulator chamber 101 from conduit 125. The valve 98 is actuated by pilot valve 111 as described to allow pressurized air of the accumulation chamber 101 to deflect diaphragm (corresponding to diaphragm 107 in FIG. 3).

At the moment that the disc (corresponding to 119), which is attached by a rod (108) to a diaphragm (107), breaks the seal from the annular ridge (117), extending a port (118), the pressurized air within chamber 101 instantly discharges through aperture 59 into connected chamber 58, which is shaped to generate a supersonic flow with a shock. This pressure wave is directed towards launching bore 47 and will be effective to accelerate the projectile within bore 47 and barrel 48 to a muzzle velocity of over 70 m/sec. Vavle 99 operates in the same manner as valve 98 whereby pressurized air is discharged into an aperture (118) through bore 63 to a non-annular chamber 62, which incorporates a concave nozzle insert 61. Thus the filling yarn extending from a storage unit 209 (FIG. 1) into the convex portion of nozzle insert 61 is propelled through filling chamber 62 and through launching bore 47 and barrel 48 into the sharp shed. Located along the open end portion of bore 73 are two unidirectional check valves 88 pneumatically connected to port 75 by bore 74, which pneumatically extend bore 73 to allow pressurized air to enter chambers 62 when not pressurized by high pressure valve 99. The valve 88 consists of two chambers 86 which each is communicating with bushing 120 which extends from the air passageway 87 connecting chamber 62 with valve chamber 86. The chambers 86 are also pneumatically connected to bore 73 by chamber extensions bore 85. A steel ball 119 within the chamber 86 between bushing 120 and extension bore 85 seals off the bore 85 when chamber 62 is pressurized by valve 99, so that high pressure air cannot pass into bore 73.

The purpose of check valve 88 is to have a constant flow of pressurized air through channel 62 so that a filling yarn disposed therein will be transferred from storage 209 to a projectile when filling is released from storage unit 209, and deposited in the portion 33 of projectile shell 32 in the manner set forth in the previous section describing the projectile 30. When the projectile is launched and the filling propelled behind it, the higher air pressure from valve 99 will enter check valve chamber 86 through bushing 120. Consequently, the condition of pressure difference between chamber extension bore 85 and valve chamber 86 will force the steel ball into sealing engagement against orifice of bore 85.

Referring particularly to FIG. 2, the filling is disposed into projectile 30 by a vortex air flow from annular insert 78 located at the bottom portion of bore 47 adjacent to chamber 58. The air flows through an annular groove 79 at the outer cylindrical surface of insert 78, thence through a bore 77 which longitudinally penetrates a concave-shaped internal cylindrical portion of insert 78. Pressurized air from source 26 is supplied by conduit 82 to a groove segment 80 within bearing surface of bearing 45, which is pneumatically connected to groove 79 of insert 78 by bore 84, which penetrates the bearing wall and the wall of housing 42. The purpose of bore 77 is to create a vortex with high rotational velocity in front of the exit of chamber 62 so that a centrifugal circular motion is applied to the filling extending through chamber 62 while the filling is being inserted in the projectile in a manner described in the projectile section.

Again referring to FIG. 2, the valve control means comprises an electrical impulse disc 122, a sequence sensor 123, and an electronic valve control device 124, all of which are known in the art. The impulse disc 122 represents the revolutions of the main shaft of the loom and indicates each revolution by means of an electronic gate 121 placed at the circumference of the disc 122. A sequence sensor 123 transmits an impulse to valve control unit 124 each time the gate passes the stationary sensor head 123. The timing relation of the pilot valves to the main shaft of the loom and to each other is determined by electronic components within valve control unit 124. The gears 67 and 68 located on launching block 57 which are engaged in gear segment 69 and 70 applies an intermittent rotational movement of 180° to filling insertion block 57 and 60. The purpose of the reciprocating motion of blocks 57 and 60 bearing the filling insertion systems is to alternate positions of projectile with reference to launching and projectile loading conditions. The exact sequence of positioning will be described in a later section.

PROJECTILE RECEIVING DEVICE

Referring to FIG. 1, projectile receiving means 126 and 126' are located between each loom section. Two receiving units, left and right hand, each have two projectile receiving bores 131. Alternatively, e.g. in a single loom, a left or right hand receiving unit could be located opposite a launching unit at either one of the loom sides generally indicated by the reference numeral 22 of FIG. 1.

Only one of the devices will be described in detail, namely 126, since both devices are essentially identical. Comparable portions of device 126' will bear the same reference numerals as for device 126 with the addition of a prime.

Figures 6, 7:
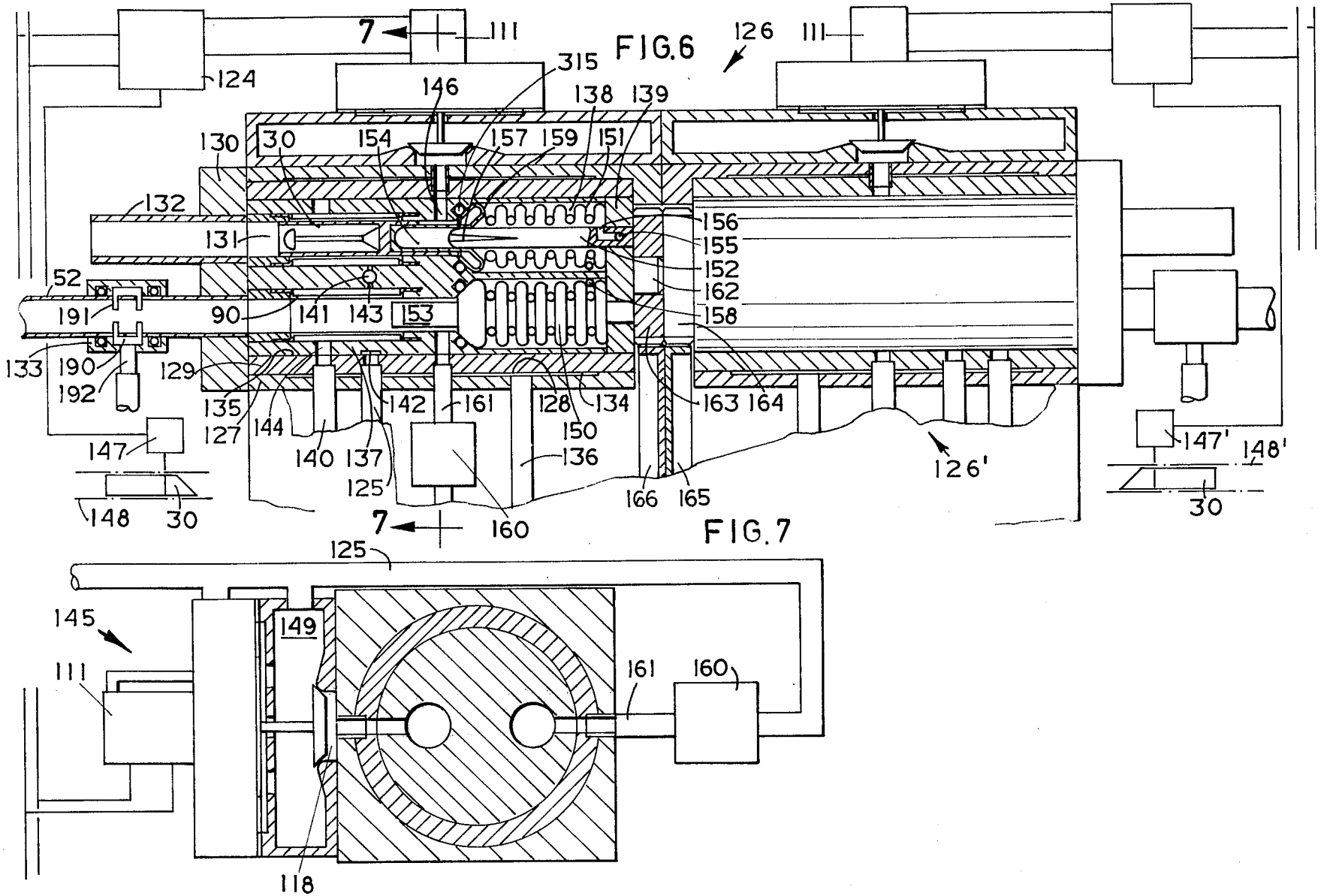
FIG. 6 is an enlarged longitudinal cross section of a projectile receiving device shown at 126 in FIG. 1.
FIG. 7 is an enlarged horizontal section taken along the line 7—7 of FIG. 6 looking in the direction of the arrow.

Referring particularly to FIGS. 6 and 7, the receiving device comprises a housing 127 which has a bore 128 wherein is located an air bearing 129 and a housing extension 130, which forms a part of receiving bore 131 by means of cylindrical tubular barrel 132. The projectile conveying means 52, connecting launching unit 40 with receiving device 126, is attached to extension 130. The central axes of receiving barrel 132 and conveyor tube 52 of course are situated at the same angle as that between the launching barrel 48 and conveyor tube 52. See line *z—z* in FIGS. 12 and 13. An annular groove 134 within bore wall 128 and around the air bearing 129 is supplied with pressurized air from a source 26 through a conduit 136. The air bearing 129 is made of porous material to allow pressurized air to penetrate from groove 134 toward bearing surface 135. Confined by bearing 129 and housing extension 130, a cylindrical block 137 has two identical projectile receiving systems each consisting of projectile receiving bore 131 leading into bores 138 which are covered by a plate 139. There is a pneumatic projectile holding unit 90 located along the bore 131 which is forming a part of the wall of bore 131 and is shown in greater details in FIGS. 4 and 5. The holding unit 90 is supplied with pressurized air from the high pressure source 26 through conduit 125 to bore 141 by means of a groove segment 142. The flow restricting ports 143 from bore 141 to each unit 90 determine the air constant flow to unit 90.

A bore 144 from holding unit 90 through the block wall, the air bearing wall and the housing wall connects unit 90 to the atmosphere by conduit 140 when the block is moved from the projectile receiving position to the projectile transfer position. The pressure within holding unit 90 is released through conduit 140 and the engaged projectile therein will then be transferred into conveyor device 52 without hindrance. The bore 144 from the second receiving system, which is in line with projectile flight path, also penetrates the block wall but remains pressurized by the sealing effect of the air bearing. When a projectile has arrived from the launching chamber 47 through barrel 132 in bore 131, the projectile is held in position. There is a valve 145 (FIG. 7) identical to valves 98 or 99, that supplies pressurized air from high pressure system 26 to bore 146 intersecting receiving bore 131 until a projectile in flight triggers the sensor head 147 located within the flight path 148 of projectile 30. An electrical signal from sensor 147 to a valve control will actuate valve 145 by pilot valve 111 and a metered volume of pressurized air will discharge from the accumulator chamber 149 through port 118 and bore 146 into bore 131 while projectile is entering barrel 132 so that the potential energy of projectile 30 will be reduced by compressed air and the deceleration of projectile 30 takes place until projectile 30 makes contact with a bumper 150. The bumper, situated one in each of bore 138, comprised of an impact head 153, a bellows 150, and a mandrel 152, is attached as a unit to cover plate 139 at the longitudinal center axis of impact head 153 and flexible bumper bellows 151. The cylindrical mandrel 152 is anchored in plate 139, from which the mandrel extends into the cylindrical chamber 154 of impact head 153. Bore 155, reaching inside of mandrel 152, is pneumatically connected by bores not shown in FIG. 6 to port 141 which is supplied with pressurized air from the high pressure system 26. The condition of constant pressure applied to the internal space of bellows 151 through flow restricting port 156 branching off bore 155 is effective as a cushion within the impact head 153 and bellows 151 when the projectile makes contact with impact head 153. The impact head is capable of sliding along the mandrel 152 which limits the stroke of the impact head when the convex mandrel end is engaged with concave bottom of head chamber 154. A slight conical groove 157 is set in outer surface of mandrel 152 and extends to chamber 154 of the impact head to allow pressurized air to enter chamber 154 while the bumper is in the expanded position shown in FIG. 6. When the bumper 151 is being compressed by the inertial energy of projectile 30, air is forced out of chamber 154 through the decreasing orfice along the conical groove 157. For the purpose of pneumatic separation of bore 131 from bore 138, an annular seal 315 is confined in an annular groove within the conical portion of bore 138, which is pneumatically connected by a bore 158 to the atmopshere. When the projectile makes contact with bumper 150, the collar 159 will break the seal and allow the pressure, which builds up in bore 131 during the deceleration period of the projectile, to discharge into the atmosphere.

The recovery of bumper 151 towards its primary position against seal 315 is also effected by the restricted air flow through mandrel groove 157 for the purpose of limiting the recovery expansion speed of bumper 151 so that the projectile shell which is in contact with impact head 153 will not rebound, but will remain within bore 131 held by holding unit 90 until projectile 30 has been transferred to the position of the conveyor means 52. The projectile is pushed into conveyor tubing 52 by pulsating air shocks supplied from an oscilator 160 which is pneumatically connected by conduit 161 and bore 146 through the walls of housing 127 and bearing 129. Rotation from the projectile receiving position to the transfer position is about shaft 162, attached in the longitudinal center axis of the cover plate 139. A pair of gears 163, 164 are mounted on the cover plate, and engage gear segments 165 and 166, which are connected to a cam motion by means of a rigid member not shown, which cam motion is connected to a source of rotational energy, e.g., the loom main drive. Gear segments 165 and 166 are responsible for alternating the position of projection within the receiving bore 131 by an intermittent rotary motion of 180°.

PROJECTILE GUIDE AND BEAT-UP MEANS

Figure 11:
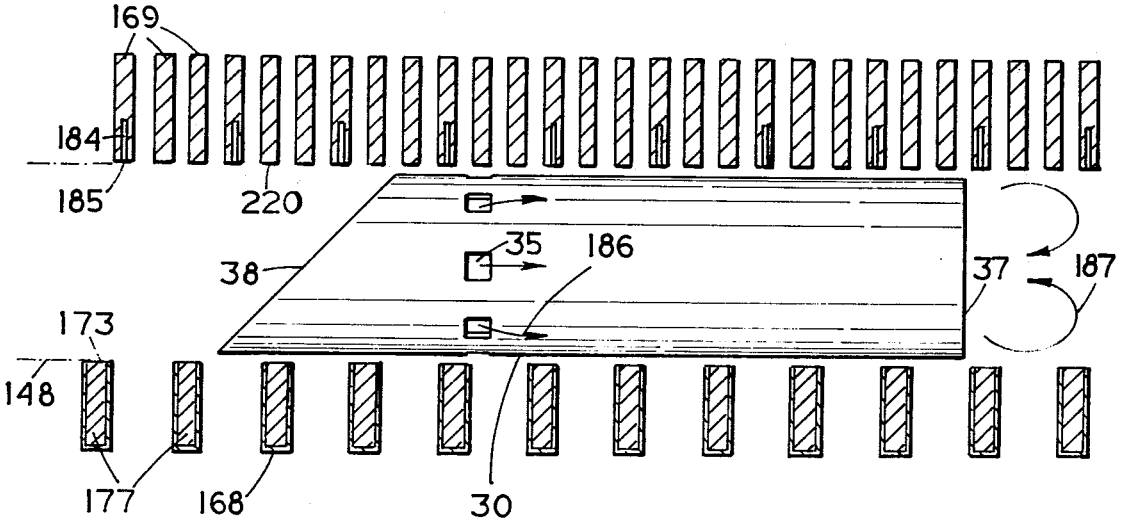
FIG. 11 is a vertical section taken along line 11—11 of FIG. 13 showing several reed blades and projectile guides.
Figure 12:
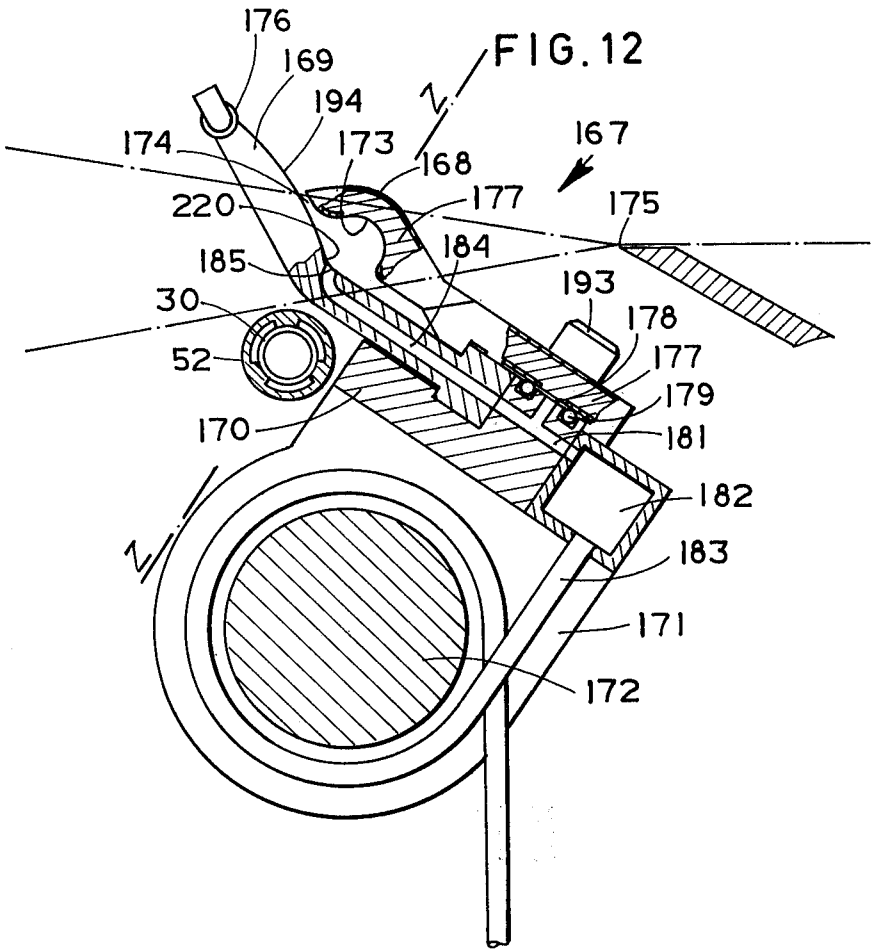
FIG. 12 is a vertical section taken along line 12—12 of FIG. 1 looking in the direction of the arrows showing the combination of reed and projectile guide.

Referring to FIGS. 1, 11, 12 and 12, the projectile guide and beat-up means is indicated generally at 167 and comprises a plurality of spaced guides 168 and reed blades 169 which are fastened to the lay bar by means of bolts 193 and attached to a plurality of lay brackets 171 which are mounted to a rocker shaft 172. Each guide has a segmented surface 173 with a radius that is slightly larger than the radius of the projectile circumference.

Each reed blade 169 also has a projectile guiding segment portion 220 located opposite the segmented surfaces 173 of the guide. The guide 168 and reed blades 169 collectively form a guide channel 148 for the projectile 30. This guide channel 148 is shown in FIG. 11, indicated by the reference numeral 148. Once the projectile is propelled through guide channel 148 and a pick of filling inserted thereby, the lay moves forward to the beat-up position (FIG. 13) whereby the front contour 194 of the plates combs a filing pick upwardly along the contour 194 throiugh the space 174 between guide 168 and blades 169 toward the fell 175. As the lay reaches the beat-up position, the guide extending portion of the blades 169 which represents the beat-up edge is effective to beat the filling into the fell 175, while the projectile guide 168 passes beneath the fell line. A coil spring 176, spacing the blades 169 in the upper portion of the reed, is effective to keep the warp yarns from leaving their proper place between the blades. The various loom components are so timed, and reed and guide are so positioned on the lay, that reed and guide segmented portion 173 and 220 will be within the speed opening, indicated by dot and dash line at FIG. 12, and in perfect line with launching barrel 48 and receiving barrel 132 when the projectile is fired. The projectile is propelled by launching unit 40 at a subsonic velocity. The average projectile speed will depend on width of the loom, weaving speed and other periodic considerations. The projectile velocity should be sufficiently high so that as the projectile travels through channel 148, it will just lose a small fraction of its muzzle velocity.

The guide member 168 has a segmented surface parallel to the longitudinal axis of the channel 148 and has a porous core 177 that is exposed to the atmosphere at the projectile guiding surfaces 173. Pressurized air flows through that surface to help support the projectile, via an annular chamber 178 within an annular seal 179 that is pneumatically connected by bore 180 intersecting bore 181 which penetrates through lay bar 170 and leads with one end into an air supply channel 182 which is pressurized from high pressure source 26 by flexible conduit 183. Pressurized air penetrates from chamber 178 throughout the porous core 177 of the guide to the exposing segmented surfaces 173 and exhausts out of the pores to create an air cushion for the projectile. Air is also forced through orifice 185 in the plurality of reed blades 169 by means of a passageway 184 which connects with bore 181 and thus to supply channel 182, as well as to the orifice 185 through which pressurized air is flowing. From each orfice 185, located within segmented portion 220 of the reed blades, a small jet of air blows across the channel 148 towards the guide 168. When a projectile is situated anywhere along channel 148 it is forced by means of those jets against the air cushion of guide 168. The purpose of the positive air cushion is to keep projectile 30 from making contact with a reed or guide at any time, which can otherwise occur, especially when lay unit 167 is vibrating.

The above guiding assistance so effects the aerodynamics when projectile 30 is advancing through channel 148 at high speed that there is a pressure build-up in the hollow front portion 31 of the projectile, which is effective as an air scoop, and the air within that scoop 31 becomes super atmospheric.

Referring to FIGS. 8–11, projectile shell 32 has a plurality of slots 35 connecting scoop chamber 31 with outer shell surfaces through which the super atmospheric pressurized air is directed into the surrounding space between reeds 169 and guides 168 as indicated by arrows 186 in FIG. 11. When these slots 35 pass reed blades 169 and guide surfaces the air flow out of scoop 31 is suddenly restricted by a change of air flow direction intermittently caused by the primary air flow of the expelling jet from orfice 185 of reed blades and the air exhausting from the segmented guide surfaces 173. The pulsating interference of those counteracting air flows ensure that the front end of the projectile will be stable throughout its flight through channel 148. The trailing end 37 of the projectiles open shell, which is not streamlined, creates a projectile-trailing wake 187 which is of subatmospheric pressure and is the cause of a substantial back flow in the direction from the contour 37 or 228 through the projectile shell 32 toward and through the slots 36 disposed at the front flow deflector 34 into scoop chamber 31 into the vicinity of projectile 30. The above aerodynamic condition effectively combines with the air cushion provided around the projectile to enable projectile 30 to be propelled and guided through the warp shed by means of channel 148 in a precise trajectory without mechanical friction losses. The above construction of guiding means also allows greater freedom and substantial variations of size and weight of projectiles without adverse effects.

Figure 13:
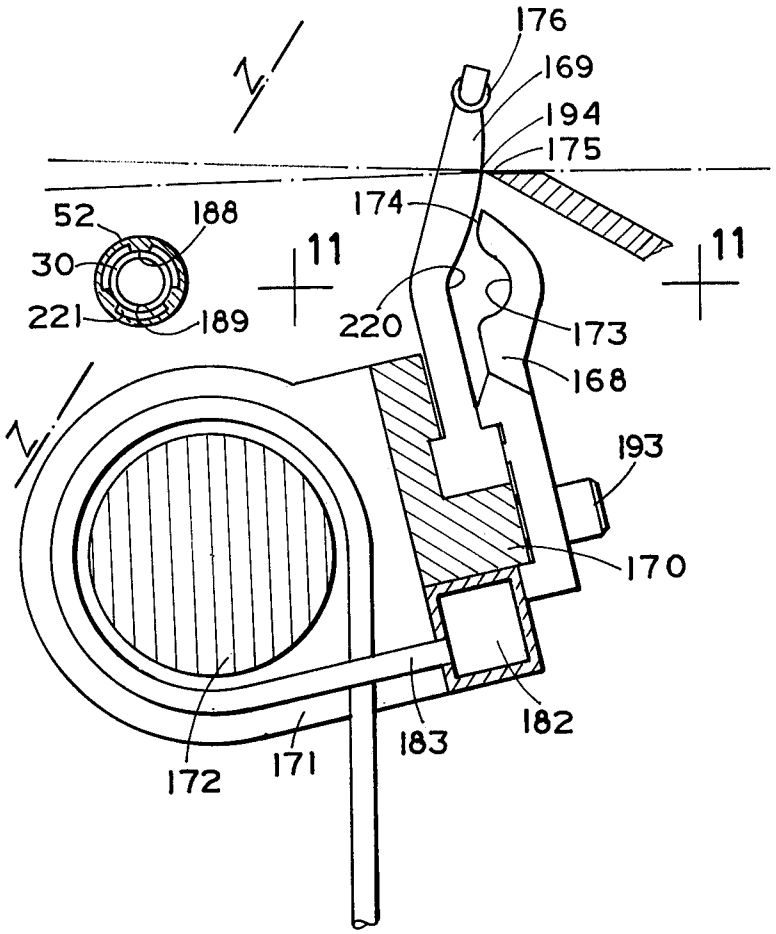
FIG. 13 is a vertical section taken along the line 12—12 of FIG. 1 showing the combination of reed and projectile guide in the beat-up position.
Figure 21:
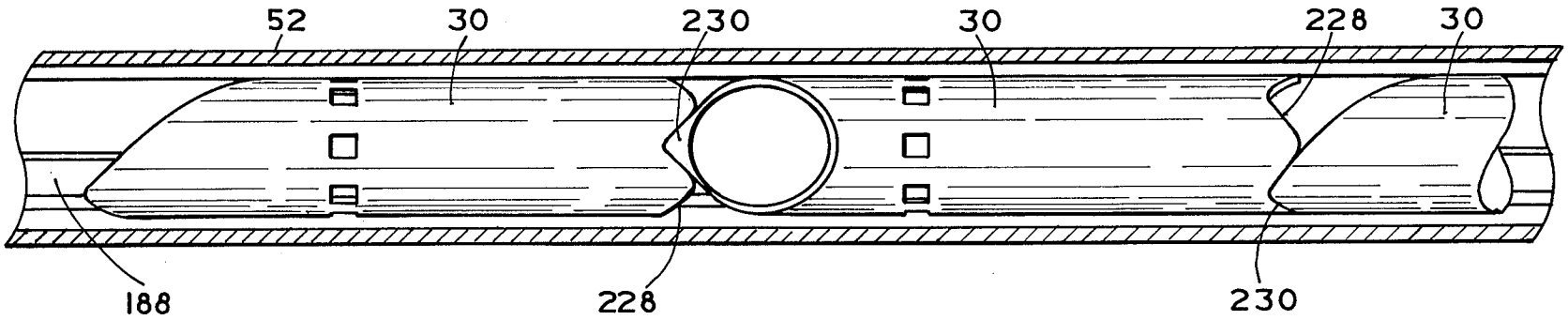
FIG. 21 is a longitudinal cross section of conveyor 52 (FIG. 2) carrying nested projectiles being transported back to the launching unit.

Referring to FIGS. 13 and 21, a conveyor member 52 which connects launching unit 40 (FIG. 3) with receiving device 126 (FIG. 6) has a cylindrical outside configuration and the inner portion has a plurality of ridges 188 parallel to its longitudinal axis situated evenly at spaced intervals around its internal cylindrical wall 189. The purpose of conveyor member 52 is to transfer the projectiles 30 from receiving device 126 back to launching unit 40 by means of projectiles 30 pushing one another within a chain of projectiles. As shown in FIG. 21, when a projectile has arrived, the receiving device 126 will be brought to the longitudinal axis of conveyor tubing 52 by a rotary movement of 180° of block 129. A determined series of pulsating pressure shocks, supplied through conduit 161 from oscillator 160, move the entire column of projectiles intermittently toward empty launching bore 47 within launching unit 40 until each projectile, in turn, is inserted into the empty launching bore 42 which is in registration with conveyor tubing 52, the and holding device is activated to hold the returned projectile in proper position.

Bushing 133, located on the outer cylindrical surface of the conveyor tubing, has within it an annular space 190 around the cylindrical surfaces of conveyor 52. That space is sealed by annular seals confined in each end portion of the bushing space 190, which is pneumatically connected to the interior of tubing 52 by slots 191 penetrating through the wall of conveyor tubing 52. A hose from adapter 192 to a vacuum source (not shown) applies subatmospheric pressure through the annular space 190 of bushing 155 along the space 221 within the projectile conveying 52, and is effective to ensure that each projectile within the conveyor has contact with adjacent projectiles. The same subatmospheric pressure also assists the filling deposition in projectile shell while it is still being transferred through the conveyor towards launching bore 47 by allowing the flow of air into bore 47 from channel 62 at a greater velocity.

GENERAL OPERATION

Figure 14:
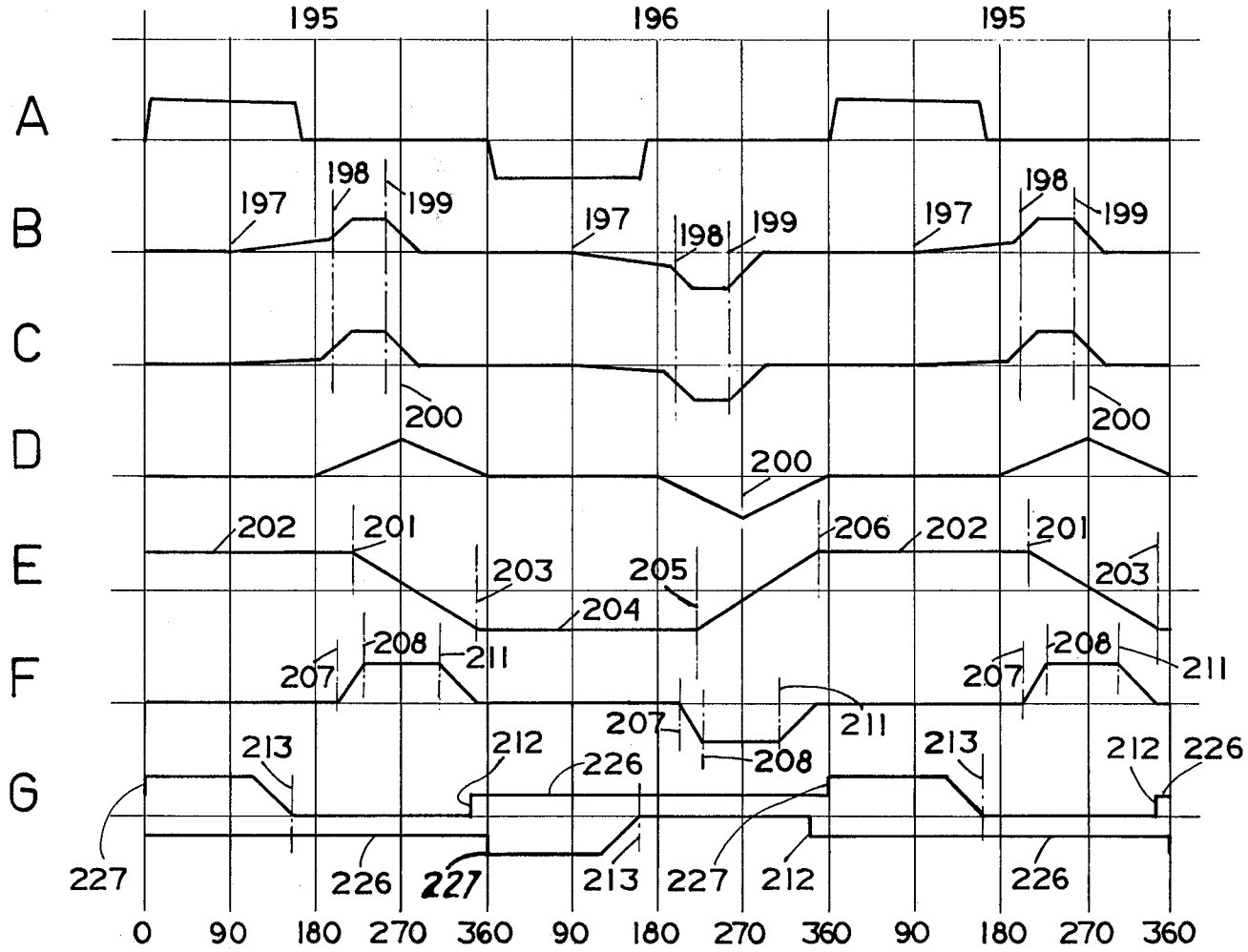
FIG. 14 is a graphical presentation of the related motions of the components as a function of the rotation of the main loom drive shaft.

Referring to FIG. 14, in order not to conceal the essential elements of the loom, apparatus for inserting yarn are shown in FIG. 14, which has been rotated by 90°, and referring to numeral references 195 and 196 which illustrate the position of the different elements which have been plotted as functions of the rotation of main shaft of loom in a graph of FIG. 14 in which:

A is the motion of the projectile,
B is the motion of the cutter and gripper at the launching end,
C is the motion of the cutter and gripper at the receiving end,
D is the motion of the lay,
E is the motion of the launching and receiving system,
F is the motion of the weft yarn front end pre-feed of the storage device, and
G is the motion of weft yarn from the storage device.

Referring to FIG. 14, there is shown the flight of the projectile 30 at curve A, which indicates the maximum limits between the starting point of the flight and the contact with bumper 151, which governs the projectile in its state of rest after it has come to a halt within one of the bores 47. There is a cutter and gripper unit 29 (FIG. 1) located at the exit of launching barrel 48 facing the entrance of the passageway between the reeds and the guides. From a dwell position the cutter and gripper begins to advance at 197 towards the filling and cutting position, and at point 198 the inserted weft yarn 214 is cut and clamped by the unit 29. The gripper blades hold the weft yarn 214 at 215 (FIG. 15) until to the point in time shown in FIG. 14 at 199, which is near the time of the beat-up, shown at point 200 on lay curve D. After point 199, the gripper rapidly opens and drops the weft yarn at the fell line while at the same time unit 29 returns to its dwell position, to remain there until the next cycle. There is also a cutter and gripper unit 329 (FIG. 1) situated at exit of the guide 167 facing entrance of receiving barrel 132. This cutter and gripper is identical to the one located at the launching end. The movement of cutter and gripper 329 is represented at curve C (FIG. 14). This movement is generally similar to that of cutter and gripper 29, but preferably there is a somewhat slower advancement approaching cutting and clamping point 199 so that the projectile clears cutting and gripping mechanism 329 as it enters the receiving device 126. Both cutting and gripping mechanisms can be of known type, such as that shown in U.S. Pat. No. 3,598,158, incorporated herein by reference. A lay drive applies a displacement to the lay after a minimum dwell of 180°. The exact timing of beat-up point 200 curve D is variable, but generally it is arranged so that the forward and return movements are equal.

The rotation of the system blocks with reference to launching unit 40 and receiving device 126 is displayed at curve E. The launching and receiving units dwell in the same position during the time in which a filling is inserted and such dwell times are shown at times 202 and 204 in curve E. At point 201, which is after the cutting and clamping of the filling by cutter and clampers 29 and 329, both blocks are given a rotation of 180° from point 201 to 203 in order to change position of projectiles for a next pick during dwell 204. Thereafter the blocks alternate again within points 205 and 206 for the following pick or filling insertion.

A front end 210 weft yarn extending to barrel 48, indicated in FIGS. 15–19, is created after an inserted yarn is cut and clamped by gripper 29 at point 198, curves B and C (see FIG. 19) and is pulled back into bore 47 (see FIG. 15) between the points 207 and 208 of curve F by means of a conventional filling retracting device within the storage device 209. This yarn front end 210 is held in position within bore 47 by means of storage device 209 of FIG. 1 so that the yarn end 210 does not extend beyond bore 47 while it is changing position. Thereafter this yarn front end 210 is released from storage device 209 at point 211, preferably even before bore 47 has reached its dwell position, and is fed into a projectile 30 which is positioned at the exit of conveyor 52. A pre-measured weft pick, which is measured while being pulled off the filling cones 222 and 224 of FIG. 1 and stored in storage device 209, is taken at point 212 of curve G from storage device 209 by means of air flow through channel 62 and fed into the projectile where the weft front end 210 already is disposed. The weft yarn movement which has started to be deposited in the projectile at point 211 continues throughout 226 to point 227 from where the pick is inerted into shed *y* up to the time indicated at 213, and held at its front end 210 by a vacuum nozzle (not shown) until the gripper units 29 have secured both ends of pick 214 indicated in FIG. 15 at points 199 of curves B and C of FIG. 14.

Figures 15, 16, 17, 18, 19:
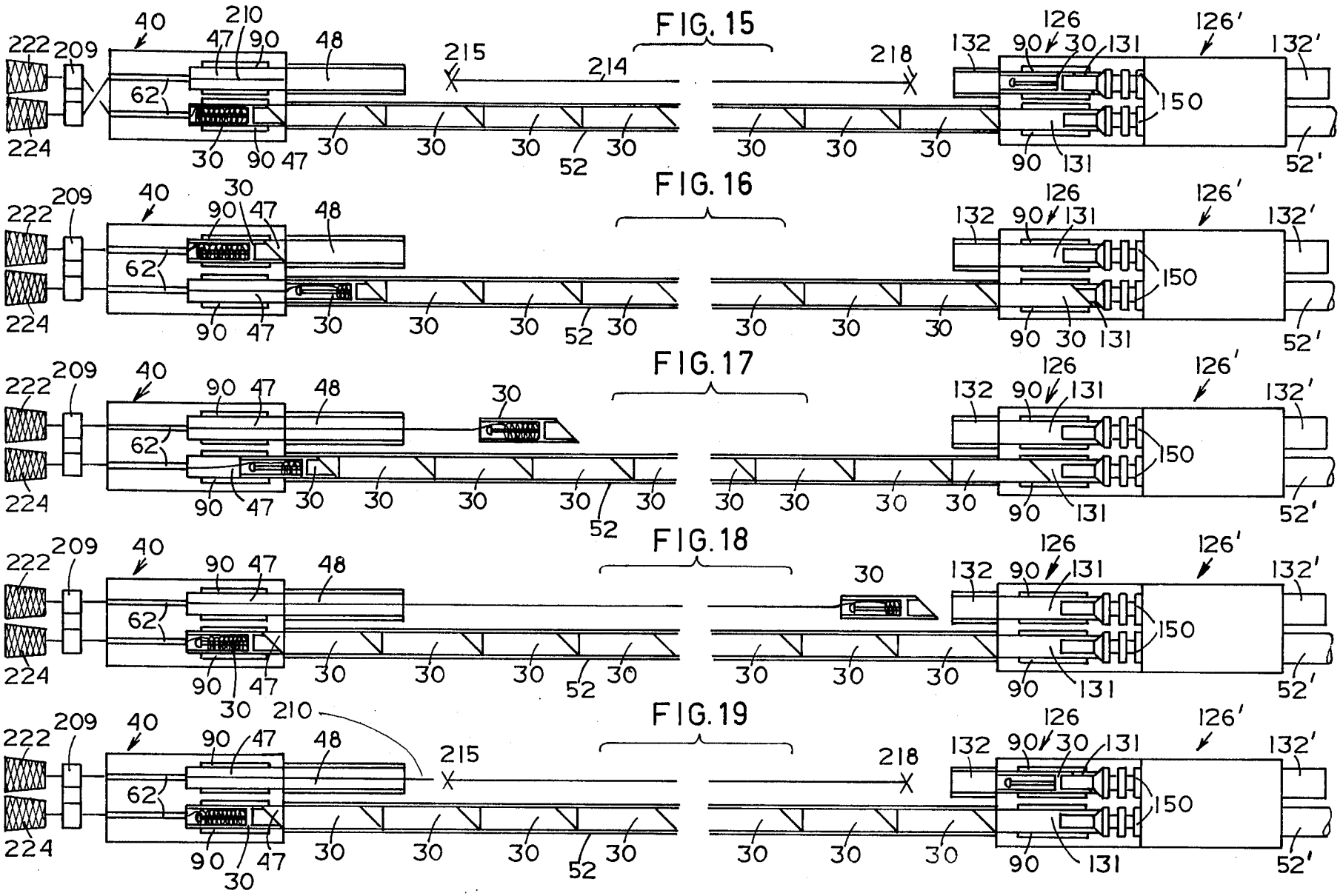
FIGS. 15–19 are diagrammatic operational views of the operation of the left hand section of the loom.

Referring to FIGS. 15–19, these depict a filling insertion cycle. In FIG. 15, the projectile 30 has just been received in bore 131 at the receiving unit 126. At this point the filling which has been inserted from storage device 209 is cut and clamped by left and right hand units 29 at points 215 and 218. The cut end 210 which extends back to storage unit 209 has already been pulled back into launching bore 47 by means of storage device 209. The lay advances to the front position to beat the filling, which is indicated at 214, and then cutter and gripper units 29 are open to release the filling 214 on both ends at points 215 and 218. The projectile which has been pushed in bore 47 is filled with yarn in form of cylindrical coils by means of channel 62. As shown at FIG. 16, the projectile has just been transferred from the position which is in line with the return conveyor to the launching position within unit 40. The valves associated with the filling insertion system operate in a manner such that after up to a pick of weft is disposed in the projectile shell 33 and the holding device 90 is depressurized, the projectile is propelled. If a filling portion is still being stored in storage device 209 at the time the projectile is fired, the yarn is still fluidically assisted while following the projectile as shown in FIGS. 16 and 17. According to FIG. 17, the column of projectiles within conveyor 52 is slidably shifting toward an empty bore 47. As soon as the preceding projectile is transferred to the launching portion, the retracted cut weft end 210 is released from the storage unit, and begins to become disposed in projectile shell even before the shell enters empty bore 47. The continuation of projectile flight and the preparation of a projectile flight and the preparation of a projectile with a filling for the next pick by means of channel 62 with yarn from storage unit 209 as shown in FIG. 18.

The loom is timed so that when the projectile reaches a certain point on its flight through the warp shed and the premeasured pick from storage unit 209 has been exhausted, while weft pick end is secured by storage unit means, the projectile continues its flight towards the receiving unit 126 but the remaining coiled portion of filling inside of shell 33 unwinds, as shown in FIG.

18, so that the leading weft front end 210 will be dropped immediately after point 218 and held by suction device (not shown) and slightly tensioned until cutter and gripper units 29 cut and clamp the weft 215 at indicated points 215 and 218 in FIGS. 15 and 19, and the beat-up blade beats the filling into the fell. A bumper within the receiving device will bring projectile 30 to a final stop, and a holding unit 90, which at this time is pressurized, keeps the projectile in position shown in FIG. 19. The inserted weft pick is separated at point 215 by cutting means from yarn which just has been drawn from storage unit 209. Another filling pick is indicated as having its cut end at 210 in FIG. 19. After the yarn is cut at point 215, the storage device retracts this cut end 210 back into bore 47. In order to insert a next pick, the projectile within bore 47, which is in line with the conveyor exit, will be transferred into launching position, shown in FIG. 16, and weft end 210 is moved into position associated with reloading of projectile in bore 47 facing conveyor 52. The weft is released to dispose in the next empty projectile according to the sequence of operation as previously described.

The specific embodiments described herein are meant to be exemplary only, and various modifications will be apparent to those of any skill in the art. The claims below are intended to cover all such modifications as fall within the true spirit and scope of the invention.

I claim:

1. A loom, comprising means for forming a warp shed, inserting means mounted at one end of said warp shed for inserting a filling pick into said warp shed, said inserting means including conduit means for holding and conveying a projectile, said conduit means being transferable from a first position to a second position, said conduit means being connected at one of said positions to a source of fluid under pressure, for propelling said projectile through the warp shed, and said conduit means being connected in at least one of said positions to means for disposing filling within said projectile, and further comprising a tubular fluid supply means connected tangentially to said conduit means at a point adjacent the connection to the filling disposing means, whereby fluid under pressure entering said conduit means via said fluid supply means creates a vortex through which said filling must pass prior to disposition in said projectile.

2. The apparatus of claim 1, wherein said loom further comprises receiving means at the end of the warp shed opposite from the inserting means for receiving and stopping said projectile upon completion of its flight through the warp shed, said receiving means comprising a receiving chamber for receiving and holding said projectile, said chamber containing braking means for stopping the projectile upon entry to said chamber.

3. The loom of claim 2, further comprising a return conduit adapted to return projectiles to said inserting means.

4. The loom of claim 1, wherein said means for disposing filling within the projectile comprises a chanel having access to a filling supply and means for exposing filling from said supply to air under pressure, so as to direct said filling through said channel and into said conduit means.

5. The loom of claim 1, wherein said conduit means further comprises a holding device for holding said projectile within said conduit means prior to propulsion through the warp shed.

6. The loom of claim 1, wherein said conduit means is connected to filling disposing means in both said first position and said second position.

7. The loom of claim 1, further comprising projectile guide means for guiding said projectile through said warp shed, said projectile guide means comprising a plurality guide members each having a generally circular opening transverse to and in axial alignment with the path of the projectile through the warp shed, said guide members comprising means for forming an air cushion on one side of the projectile path, and means on the other side of the projectile path for urging said projectile against said air cushion.

8. The loom of claim 7, wherein the means for forming an air cushion comprise a plurality of openings in the generally circular surface portion of said guide means.

9. The loom of claim 7, wherein the means for urging the projectile comprises a rigid member having a surface adjacent the projectile path, said surface having at least one fluid discharge opening for directing fluid under pressure against the side of the projectile as it traverses the projectile path.

10. The loom of claim 9, wherein the rigid member comprises a reed blade having a beat-up edge for beating the filling into the fell.

* * * * *